US007343880B2

(12) United States Patent
Bergkvist

(10) Patent No.: US 7,343,880 B2
(45) Date of Patent: Mar. 18, 2008

(54) CHILD HARNESS

(75) Inventor: Hakan Bergkvist, Bromma (SE)

(73) Assignee: Baby Bjorn AB, Danderyd (SE)

( * ) Notice: Subject to any disclaimer, the term of this patent is extended or adjusted under 35 U.S.C. 154(b) by 235 days.

(21) Appl. No.: 10/534,504

(22) PCT Filed: Nov. 13, 2003

(86) PCT No.: PCT/SE03/01758

§ 371 (c)(1),
(2), (4) Date: May 11, 2005

(87) PCT Pub. No.: WO2004/049876

PCT Pub. Date: Jun. 17, 2004

(65) Prior Publication Data

US 2006/0048721 A1 Mar. 9, 2006

(30) Foreign Application Priority Data

Nov. 29, 2002 (SE) ..... 0203533

(51) Int. Cl.
*A47D 13/02* (2006.01)

(52) U.S. Cl. ..... 119/770; 224/160

(58) Field of Classification Search ..... 119/770; 224/160, 161, 158, 159
See application file for complete search history.

(56) References Cited

U.S. PATENT DOCUMENTS 5,205,451 A * 4/1993 Manzer ..... 224/161
5,632,425 A 5/1997 Hull
5,927,576 A * 7/1999 Nielsen ..... 224/161
5,934,528 A * 8/1999 Higuchi ..... 224/159
6,325,259 B1 * 12/2001 Tharalson et al. ..... 224/161
6,568,575 B1 * 5/2003 Bartholomew ..... 224/583
D507,869 S * 8/2005 Liistro et al. ..... D3/214
7,210,605 B2 * 5/2007 Willows et al. ..... 224/637

FOREIGN PATENT DOCUMENTS

EP 0 752 220 A1 1/1997
FR 2 585 940 2/1987
WO WO 84/04445 11/1984

* cited by examiner

*Primary Examiner*—Yvonne R. Abbott
(74) *Attorney, Agent, or Firm*—Jacobson Holman PLLC

(57) ABSTRACT

A child harness has two strap loops which pass around respective shoulders of the wearer and which are mutually connected by a fastener on the rear side of the harness. The harness has a child carrying pouch on the front side, so as to be supported on the chest side of the wearer. The fastener slides readily along the strap loops to assume a position that is controlled by the magnitude and the direction of the forces applied via the strap portions that connect with the fastener. The harness has a waist belt which connects with the fastener on the rear side of the harness so as to limit the distance of the fastener from the waist belt. The back piece is generally triangular in shape, with the top of the triangle connected to the fastener, and functions to transfer load to the lower part of the wearer's back.

18 Claims, 2 Drawing Sheets

CHILD HARNESS

This is a nationalization of PCT/SE03/001758 filed Nov. 13, 2003 and published in English.

BACKGROUND OF THE INVENTION

1. Field of Invention

The present invention relates to a harness that enables a wearer to carry a child.

The invention thus relates to a harness that includes a child carrying pouch which is positioned on the front side of the harness, so as to be supported on the chest side of the wearer, and that further includes two strap loops which pass around respective shoulders of the wearer and which loops are mutually fastened by means of a fastener means on the rear side of the harness.

The weight of the child is transferred to the wearer's back via the looped shoulder straps.

2. Description of the Prior Art

One drawback with known child harnesses is that the load to which the wearer is subjected on his/her back will depend on the position of the strap fastener means on the rear side of the wearer and also on the tension forces in those parts of the shoulder straps that connect with the fastener means and with the fastening point respectively.

Adjustments to the position of the fastener means are difficult to achieve and will not only result in a different location of the fastener means on the rear side of the wearer, but also in a change in the tensioning conditions relating to those parts of the straps that connect with the fastener means.

In those instances when a child harness is used by different persons on alternate occasions, (by mother and father for instance), it is difficult to adjust the strap fastener means to a position which is best for the wearer concerned at that time, with respect to the load to which he or she is subjected.

SUMMARY OF THE INVENTION

Accordingly, an object of the present invention is to provide a child harness with which the fastener means can be readily adjusted to a position that is comfortable to the wearer.

A further object of the invention is to provide a child harness that has a back piece which functions to ease the load on the wearer.

These objects are achieved either fully or partially by means of the invention.

The invention is defined as described herein.

Further embodiments of the invention will be apparent from the description herein.

According to one important feature of the invention, the fastener means is able to slide along those parts of the strap loops located on the rear side of the wearer. The fastener means will thereby take a displacement position along the straps that will depend on the tension forces acting in the directions of the strap portions that connect to the fastener means. In one practical embodiment, each shoulder strap may have a thickened edge, wherein the thickenings are provided on the mutually adjacent edges of the straps on the rear side of the harness. Moreover, the fastener means may have along each of two opposite sides an undercut groove into which the edge thickening of an adjacent strap loop is able to slide. The grooves are curved, to minimise the sliding resistance of the fastener means along the edge thickenings.

The fastener means is also curved conveniently between its groove edges, with the concave side of the fastener means facing towards the wearer so as not to lie against the wearer's back.

In one particularly preferred embodiment of the invention, the harness includes a waist belt which is connected to the fastener means by means of a back piece. The back piece will therefore set an upper limit for the distance between the waist belt and the fastener means. The back piece will preferably be flexible and therewith deformable so as to allow the fastener means to approach the waist belt when the interaction of forces in the loops promote said displacement of the fastener means. However, the back piece will preferably include a spring element that functions to stretch the waist belt and the fastener means apart by a distance that corresponds to the length of the back piece in the stretch direction. The back piece is preferably triangular in shape, with the base of the triangle extending along the waist belt and the top of the triangle connecting with the fastener means, so that the back piece will generally fill the space between the shoulder straps and the rear side of the wearer. This enables a large part of the weight of the child carried in the pouch to be applied to the wearer's back, via the back piece. Because the back piece is located in the lower part of the wearer's back, lightening of the load on the wearer will be particularly effective.

The lower part of the back piece may form a separate part of the waist belt, wherewith those parts of the waist belt that connect with the back piece may be joined by fastener or coupling elements that enable the lengths of respective belt portions to be adjusted. The belt portions are suitably connected together on the front side of the wearer with the aid of coupling elements, which may be affixed to the lower parts of the strap loops. The size of the loops, or shoulder straps, may be adjustable, in which case there is provided on the rear side of the loops a size adjusting element so that an end of the strap will extend down along the loop forwardly of the size adjusting element, therewith enabling the wearer to readily grip the strap ends and pull the same downwards to reduce the size of the loops.

The pouch can include a front piece whose lower portion is connected to the connection region between the strap loops on the front side of the harness, wherewith upper laterally orientated fasteners on said front piece are conveniently connected releasably to respective adjacent fasteners on the loops, on the front side of the harness. The coupling elements of the waist belt may connect indirectly with one another via a further coupling element on the lower part of the front piece. The strap loops and the waist belt coupling elements may both be fixedly connected to the further coupling element. Alternatively, one part of the strap loop may however, pass through a transit opening on the coupling element and pass into a waist-belt fastener element.

BRIEF DESCRIPTION OF THE DRAWINGS

The invention will now be described in more detail with reference to the accompanying drawings.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
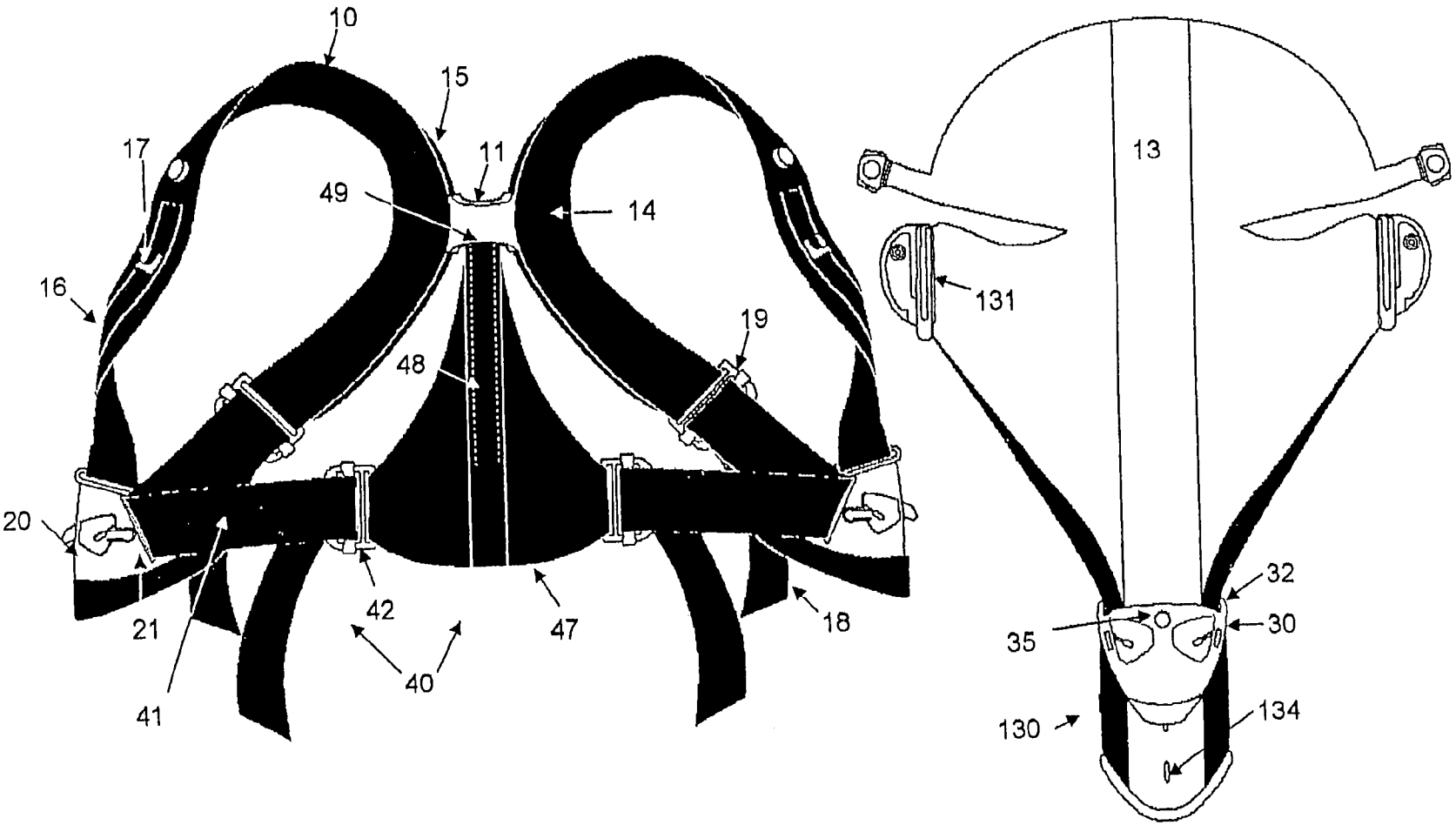
FIG. 1 illustrates the baby harness lain out in a flat state on a flat surface.

Shown in FIG. 1 is a child harness that includes two looped shoulder straps 10 which are intended to pass around respective shoulders of the person wearing the harness.

Figure 2:
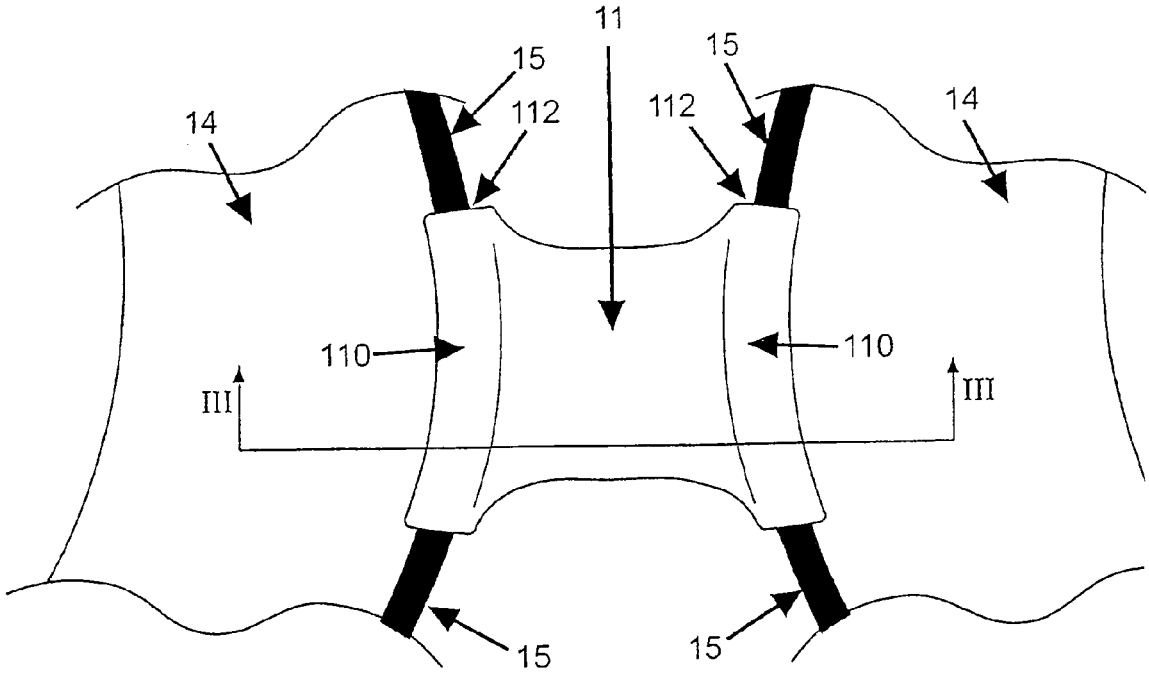
FIG. 2 illustrates a part of the harness shown in FIG. 2.
Figure 3:
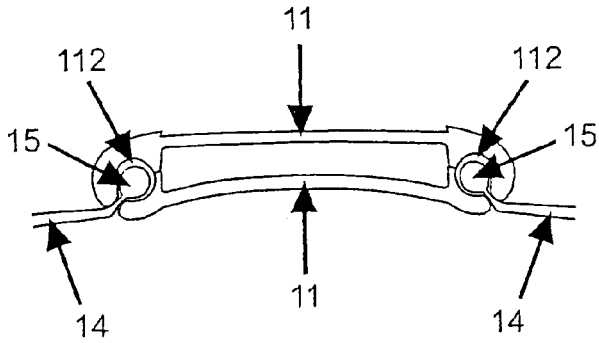
FIG. 3 is a sectional view taken on the line III-III in FIG. 2.

The harness carries on its rear side relating to the wearer a fitting or fastener means 11 which fastens together mutually adjacent parts of the loops 10. As will be seen from FIG. 1, the mutually adjacent edges of the strap portions 14 include thickenings 15. Furthermore, it will be seen from FIGS. 2 and 3 that the fastener means 11 has two opposite edges that each include an undercut groove 112 which accommodates the thickenings 15 so that they can slide along the grooves 112. The edges 110 in which the grooves are formed are curved to conform with the natural curvature of the straps 14 in the region of said connection, and hence the edges and grooves of the fastener means 11 are curved with their concave sides facing away from each other. The fastener means 11 is also curved between its edges 110 so that its concave side will face towards the wearer's back and therewith exert no pressure on the wearer's spine.

Because the edge thickenings 15 are able to slide easily through the grooves 112 on said fastener means, the fastener means 11 will take along the straps 14 a position that will depend on the tensile forces acting in the longitudinal portions of the straps 14 connected by the fastener means, and also in the direction in which said forces act. The fastener means 11 will thus slide automatically to and from positions that are favourable from a loading aspect.

It will also be seen from FIG. 1 that the harness includes a waist belt which extends between two coupling elements 20 that are connected to lower portions of the loops 10, said portions being intended to be coupled on the front of the wearer. The waist belt and the shoulder loops 10 are conveniently connected by coupling elements 20 that can be mutually connected indirectly via a further coupling element 30 which carries a lower part of a front piece 13 whose laterally disposed upper portions can be connected by releasable fasteners 131 to corresponding fasteners 17 on the front parts of the shoulder loops that extend generally vertical on the chest side of the wearer.

The front piece 13 forms a child carrying pouch. It will be seen that the lowermost part of the front piece is strip-shaped and extends through a transit loop 32 on the coupling element 30 and includes a series of discrete openings 134 that can be anchored on carrier pins 35 on the coupling element 30. The strap end of the front piece may include stop means that prevents passage through the transit loop or eyelet 32.

Both strap portions of the loops 10 may be fixedly fastened to the coupling element 20. Alternatively, one part of the loop may pass through an eyelet 21 on the coupling element and merge with an end part 41 of the waist belt 40 as shown in FIG. 1. The waist belt part/the waist belt part 41 are shown connected via a respective length adjustment element 42 on a back piece 47 that forms part of the waist strap 40. The back piece 47 extends upwardly and supports with its upper end connected to the fastener means 11 by a coupling 49 so as to provide an upper limit for the distance between the fastener means 11 and the waist belt 40. In the illustrated case, the back piece 47 is triangular in shape so that the load on the wearer will be transferred over the surface of the back piece to the region of the wearer's spine in the area between the shoulder straps 10 and the waist belt 40, beneath the fastener means 11.

The back piece 47 may comprise a flexible quilted fabric that will allow the fastener means 11 to approach the perimeter of the waist belt. In one embodiment, however, there is provided a strong elastic leaf spring 48 that extends vertically between the fastener means 11 and the lower part of the back piece such as to bias the fastener means 11 towards its end position relative to the perimeter or circumferential path of the waist belt 40 with a chosen spring characteristic.

It will be seen that each shoulder strap or loop 10 has a size adjusting element 19 from which a strap end 18 protrudes. The adjusting element 19 is situated between the fastener means 11 and the coupling element 20 on the rear side of the harness, and the strap end 18 extends generally in a direction towards the coupling element 20 so that the free end of the strap can be readily gripped by the wearer for adjustment of the size of the loop 10.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A child harness comprising a child carrying pouch positioned on a front side of the harness so as to be supported on a chest side of a wearer, and two strap loops which pass separately around respective shoulders of the wearer, the loops being mutually fastened by a fastener on a rear side of the harness, the strap of each loop having a longitudinally extending thickened edge on mutually adjacent edges of the loops on the rear side of the harness, and the fastener having along each of two opposite edges an undercut groove which slidingly receives a respective edge thickening of the adjacent strap loops to allow the fastener to slide in a longitudinal direction along the straps of the loops.

2. The child harness according to claim 1, wherein the grooved edges of the fastener are curved in a plane of the fastener such as to provide mutually opposite curvatures, wherein concave sides of the curved edges face away from each other, and wherein longitudinally extending openings of the grooves face away from each other.

3. The child harness according to claim 1, wherein the fastener is curved between its grooved edges and has a concave side that faces toward the wearer so as not to clamp against the wearer's spine.

4. The child harness according to claim 1 wherein the strap loops are connected together at a lower part thereof on the front side of the harness.

5. The child harness according to claim 4, wherein each strap loop carries a size adjusting element on the rear side of the harness beneath the fastener and wherein a strap end extends down forwardly from the size adjusting element.

6. The child harness according to claim 1, further comprising a waist belt connected to lower parts of the strap loops.

7. The child harness according to claim 6, wherein a back piece connects the fastener to the waist belt to limit a distance of said fastener from the waist belt in an upward direction.

8. The child harness according to claim 7, wherein the back piece includes a length portion of the waist belt and is connected to a respective end portion of said belt via an adjuster for adjusting the loop size of the belt.

9. The child harness according to claim 8, wherein the strap loops and the ends of the waist belt connect to respective mutually connectable coupling elements.

10. The child harness according to claim 9, wherein the coupling elements are connected to each other indirectly via a coupling element on a lower part of the pouch, and wherein upper laterally oriented parts of the pouch have a fitting for releasable connection to a respective fastener on the front side of the strap loops.

11. The child harness according to claim 7, wherein the back piece is flexible and includes a spring configured to counteract a reduction in a greatest distance between the waist belt and the fastener as defined by the back piece.

12. A child harness comprising:

a child carrying pouch positioned on a front side of the harness so as to be supported on a chest side of a wearer;

a first and a second support strap each of which is partially configured as a loop so as to pass separately around a respective shoulder of the wearer; and a slidably adjustable fastener that mutually fastens the strap loops on a rear side of the harness, each strap loop having on the rear side of the harness a longitudinally extending thickened edge portion on mutually adjacent edges of the loops, and the fastener having along each of two opposite edges an undercut groove which slidingly receives the respective edge thickened portion of the adjacent strap loops so as to enable the fastener to slide in a longitudinal direction along the strap loops and thereby provide size adjustment of the harness for various wearers.

13. The child harness according to claim 12, wherein a lower substantially horizontally oriented portion of each of the straps is connected to each other to provide a waist belt.

14. The child harness according to claim 13, further comprising a back piece that connects each end of the waist belt to the fastener.

15. The child harness according to claim 14, wherein the back piece is configured to limit a distance that the fastener can slide upwardly away from the waist belt.

16. A child harness comprising:

a child carrying pouch positioned on a front side of the harness so as to be supported on a chest side of a wearer;

a first and a second support strap each of which is partially configured as a loop so as to pass separately around a respective shoulder of the wearer and partially configured as a connectable portion of a waist belt, each strap loop having on a rear side of the harness a longitudinally extending thickened edge portion on mutually adjacent edges of the loops;

a slidably adjustable fastener that mutually fastens the strap loops on the rear side of the harness, the fastener having along each of two opposite edges a groove which slidingly receives the respective edge thickened portion of the adjacent strap loops so as to enable the fastener to slide in a longitudinal direction along the strap loops; and a back piece located on a rear side of the harness that connects each end of the waist belt to the fastener.

17. The child harness according to claim 16, wherein each of the strap loops and each portion of the waist belt is independently adjustable in length.

18. The child harness according to claim 16, wherein the back piece has a spring that extends vertically between the fastener and a lower portion of the back piece and that is configured to bias the fastener toward an upper position away from the waist belt.

* * * * *